US008366409B2

(12) United States Patent
Ochiai

(10) Patent No.: US 8,366,409 B2
(45) Date of Patent: Feb. 5, 2013

(54) RECIPROCATING PUMP

(75) Inventor: Tetsunari Ochiai, Togane (JP)

(73) Assignee: Maruyama Mfg. Co., Inc., Tokyo (JP)

( * ) Notice: Subject to any disclaimer, the term of this patent is extended or adjusted under 35 U.S.C. 154(b) by 296 days.

(21) Appl. No.: 12/824,938

(22) Filed: Jun. 28, 2010

(65) Prior Publication Data

US 2011/0027106 A1 Feb. 3, 2011

(30) Foreign Application Priority Data

Jul. 30, 2009 (JP) ..... P2009-177976

(51) Int. Cl.
*F04B 49/00* (2006.01)
*F04B 39/10* (2006.01)
*F04B 53/10* (2006.01)

(52) U.S. Cl. ..... 417/307; 417/296; 417/559

(58) Field of Classification Search ..... 417/345, 417/346, 366, 437, 559, 567, 568, 296, 307, 417/415, 454; 92/165 R, 168; 277/510, 277/511, 520, 609, 611
See application file for complete search history.

(56) References Cited

U.S. PATENT DOCUMENTS 2,544,987 A * 3/1951 Gardiner et al. ..... 418/133
3,099,500 A * 7/1963 Anderson ..... 303/49
3,125,963 A * 3/1964 Whitley et al. ..... 417/568
3,372,648 A * 3/1968 Hammelmann ..... 417/567
3,806,285 A * 4/1974 Sech ..... 417/568
3,902,404 A * 9/1975 Breit ..... 92/86
4,343,325 A * 8/1982 Fallon ..... 137/212
4,354,520 A * 10/1982 Easley, Jr. ..... 137/543.23
4,379,423 A * 4/1983 Leineweber et al. ..... 91/373
4,432,386 A * 2/1984 Pacht ..... 137/327
4,656,923 A * 4/1987 Tsuyuki et al. ..... 91/369.1
4,768,933 A * 9/1988 Stachowiak ..... 417/454
4,875,690 A * 10/1989 Tojo ..... 277/530
5,081,907 A * 1/1992 Nagel et al. ..... 91/497

(Continued)

FOREIGN PATENT DOCUMENTS

JP 61064568 U 5/1986
JP 63-057879 A 3/1988

(Continued)

OTHER PUBLICATIONS esp@cenet patent abstract for Japanese Publication No. 2005282516, Publication date Oct. 13, 2005 (1 page).

(Continued)

*Primary Examiner* — Devon Kramer
*Assistant Examiner* — Lilya Pekarskaya
(74) *Attorney, Agent, or Firm* — Osha Liang LLP

(57) ABSTRACT

A reciprocating pump is provided that does not leak working liquid to the exterior. A communicating tube 14 extends over both a first manifold 4 and a second manifold 5 such that a reciprocating member 1 constitutes a part of a reciprocating cylinder 2. An auxiliary O-ring 24 is disposed on connection surfaces 13*a* and 13*b* of a first manifold 4 and a second manifold 5 outside of the communicating tube 14 in the radial direction so that liquid leaking from at least one of a first O-ring 15 between the first manifold 4 and the periphery of the communicating tube 14 and a second O-ring 16 between the second manifold 5 and the periphery of the communicating tube 14 toward the exterior is blocked.

2 Claims, 7 Drawing Sheets

U.S. PATENT DOCUMENTS

| | | | | |
|---|---|---|---|---|
| 5,150,575 | A * | 9/1992 | Parker | 60/547.1 |
| 5,558,002 | A * | 9/1996 | Robbins et al. | 91/378 |
| 6,101,922 | A * | 8/2000 | King | 92/164 |
| 6,851,728 | B2 * | 2/2005 | Minami | 285/339 |
| 2002/0124719 | A1 * | 9/2002 | Fukui et al. | 92/155 |
| 2008/0131299 | A1 * | 6/2008 | Nakanishi | 417/437 |
| 2009/0123303 | A1 * | 5/2009 | Ohnishi | 417/270 |
| 2010/0192766 | A1 * | 8/2010 | Minoguchi et al. | 92/168 |

FOREIGN PATENT DOCUMENTS

| | | |
|---|---|---|
| JP | 2003-328956 | 11/2003 |
| JP | 2005-282516 | 10/2005 |
| JP | 2010053861 A * | 3/2010 |

OTHER PUBLICATIONS esp@cenet patent abstract for Japanese Publication No. 2003328956, Publication date Nov. 19, 2003 (1 page).

Office Action for Japanese Application No. 2009-1779796 dated Aug. 28, 2012, with English translation thereof (5 pages).

Patent Abstract for Japanese Publication No. 61-64568 published May 1, 1986 (1 page).

Patent Abstract for Japanese Publication No. 63-057879 published Mar. 12, 1988 (1 page).

* cited by examiner

RECIPROCATING PUMP

BACKGROUND OF INVENTION

1. Technical Field

The present invention relates to a reciprocating pump.

2. Background Art

A reciprocating pumps is known of which a reciprocating member reciprocates in a cylinder in accordance with a drive unit to pump liquid such as water in a pump chamber provided at the leading end in the cylinder. For example, reciprocating pumps disclosed in Japanese Patent Application Publication Nos. 2003-328956 and 2005-282516 each include a suction manifold provided with a water intake, a discharge manifold provided with a spout, a cylindrical communicating tube extending over both the suction manifold and the discharge manifold so as to constitute a part of the cylinder, a first O-ring disposed between the discharge manifold and the periphery, adjacent to the discharge manifold, of the communicating tube, and a second O-ring disposed between the suction manifold and the periphery, adjacent to the suction manifold, of the communicating tube, and prevent leakage of high-pressure liquid in the pump chamber toward the exterior.

SUMMARY OF INVENTION

An increase in length of manifolds accompanying growth in size of pumps leads to large displacement and clearance of parts due to pressure oscillation. This may cause poor sealing action of O-rings and thus leakage of liquid from the connections between the manifolds. More specifically, the liquid is discharged from the first or second O-ring via the connection surfaces of the manifolds to the exterior. In the case of toxic liquid or expensive liquid for special use, leakage of liquid to the exterior of the pump is undesirable.

An object of the present invention, accomplished to solve such a problem, is to provide a reciprocating pump that does not leak working liquid to the exterior.

A reciprocating pump (100) in accordance with a first aspect of the present invention includes a cylinder (2), a reciprocating member (1) reciprocating in the cylinder (2), and a pumping chamber (3) provided at the leading end of the cylinder (2), the pumping chamber (3) producing a pumping action. The reciprocating pump (100) further includes a first manifold (4) having the pumping chamber (3); a second manifold (5) that has the cylinder (2) communicating with the pumping chamber (3) and that is connected to the first manifold (4); a cylindrical communicating tube (14) that extends over both the first manifold (4) and the second manifold (5) so as to constitute a part of the cylinder (2); a first O-ring (15) disposed between the first manifold (4) and the periphery, adjacent to the first manifold (4), of the communicating tube (14); a second O-ring (16) disposed between the second manifold (5) and the periphery, adjacent to the second manifold (5), of the communicating tube (14); and an auxiliary O-ring (24) disposed between a connection surface (13*a*) of the first manifold (4) and a connection surface (13*b*) of the second manifold (5) outside of the communicating tube (14) in the radial direction.

Since the reciprocating pump (100) is provided with the auxiliary O-ring (24) on the connection surfaces (13*a*, 13*b*) of the first and second manifolds (4, 5) outside of the communicating tube (14) in the radial direction, the auxiliary O-ring (24) can block liquid leaking from at least one of the first and second O-rings (15, 16) toward the exterior via the connection surfaces (13*a*, 13*b*). Accordingly, the working liquid does not leak to the exterior.

Preferably, the reciprocating pump (100) further includes a relief path (25) configured to recycle liquid leaking from at least one of the first and second O-rings (15, 16) from upstream of the auxiliary O-ring (24) to regions (22, 23) in the manifolds under a lower pressure relative to the pumping chamber (3). In such a configuration, the relief path (25) can recycle the liquid leaking from at least one of the first and second O-rings (15, 16) from upstream of the auxiliary O-ring (24) to regions (22, 23) in the manifolds under a lower pressure. Accordingly, such a configuration can prevent the liquid form leaking to the exterior more effectively.

The relief path (25) may be provided to at least one of the first manifold (4) and the second manifold (5).

The reciprocating pump may further include a cylindrical vane case, the leading end, adjacent to the pumping chamber (3), of the vane case being disposed between the first O-ring (15) and the second O-ring (16), the vane case being fit on the periphery of a communicating tube (14), thereby the vane case constituting the leading-end interior the of the second manifold (31,35).

A reciprocating pump (150) in accordance with another aspect of the present invention includes a cylinder (2), a reciprocating member (1) reciprocating in the cylinder (2), and a pumping chamber (3) provided at the leading end of the cylinder (2), the pumping chamber (3) producing a pumping action. The reciprocating pump (150) further includes: a first manifold (39) having the pumping chamber (3); a second manifold (40) that has the cylinder (2) communicating with the pumping chamber (3) and that is connected to the first manifold (39); a primary cylindrical communicating tube (37) that extends over both the first manifold (39) and the second manifold (40) so as to constitute a part of the cylinder (2); a first O-ring (15) disposed between the first manifold (39) and the periphery, adjacent to the first manifold (39), of the primary communicating tube (37); a secondary cylindrical communicating tube (38) that is fit on the periphery of the primary communicating tube (37) such that the leading end (38*a*) adjacent to the pumping chamber (3) resides at the backward of a first O-ring (15) and that extends over both the first manifold (39) and the second manifold (40) in the leading-end interior of the second manifold (40); a third O-ring (41) disposed between the first manifold (39) and the periphery, adjacent to the first manifold (39), of the secondary communicating tube (38); and a fourth O-ring (42) disposed between the second manifold (40) and the periphery, adjacent to the second manifold (40), of the secondary communicating tube (38); wherein a gap between the periphery of the primary communicating tube (37) behind the first O-ring (15) and the first manifold (39) and between the same periphery and the second manifold (40) communicates with regions (22, 23) in the manifolds under a lower pressure relative to the pumping chamber (3).

In the reciprocating pump (150), the third O-ring (41) and the fourth O-ring (42) are provided on the auxiliary communicating tube (38) that extends over the connection surfaces (13*a*, 13*b*) of the first and second manifolds (39, 40) and that is fit on the periphery of the primary communicating tube (37) such that the leading end (38*a*) adjacent to the pumping chamber (3) resides behind the first O-ring (15); hence, the third O-ring (41) and the fourth O-ring (42) can block the liquid leaking from the first O-ring (15) toward the exterior. In addition, the gap between the periphery of the primary communicating tube (37) behind the first O-ring (15) and the first manifold (39) and between the same periphery and the second manifold (40) communicates with the regions (22, 23) in the manifolds under a lower pressure than the pumping chamber (3), thus, the leaking liquid is recycled to the regions (22, 23)

in the manifolds under a lower pressure via the gap. Accordingly, the working liquid does not leak to the exterior.

Accordingly, the reciprocating pump of the present invention does not leak liquid to the exterior.

DESCRIPTION OF EMBODIMENT

First Embodiment

Figure 1:
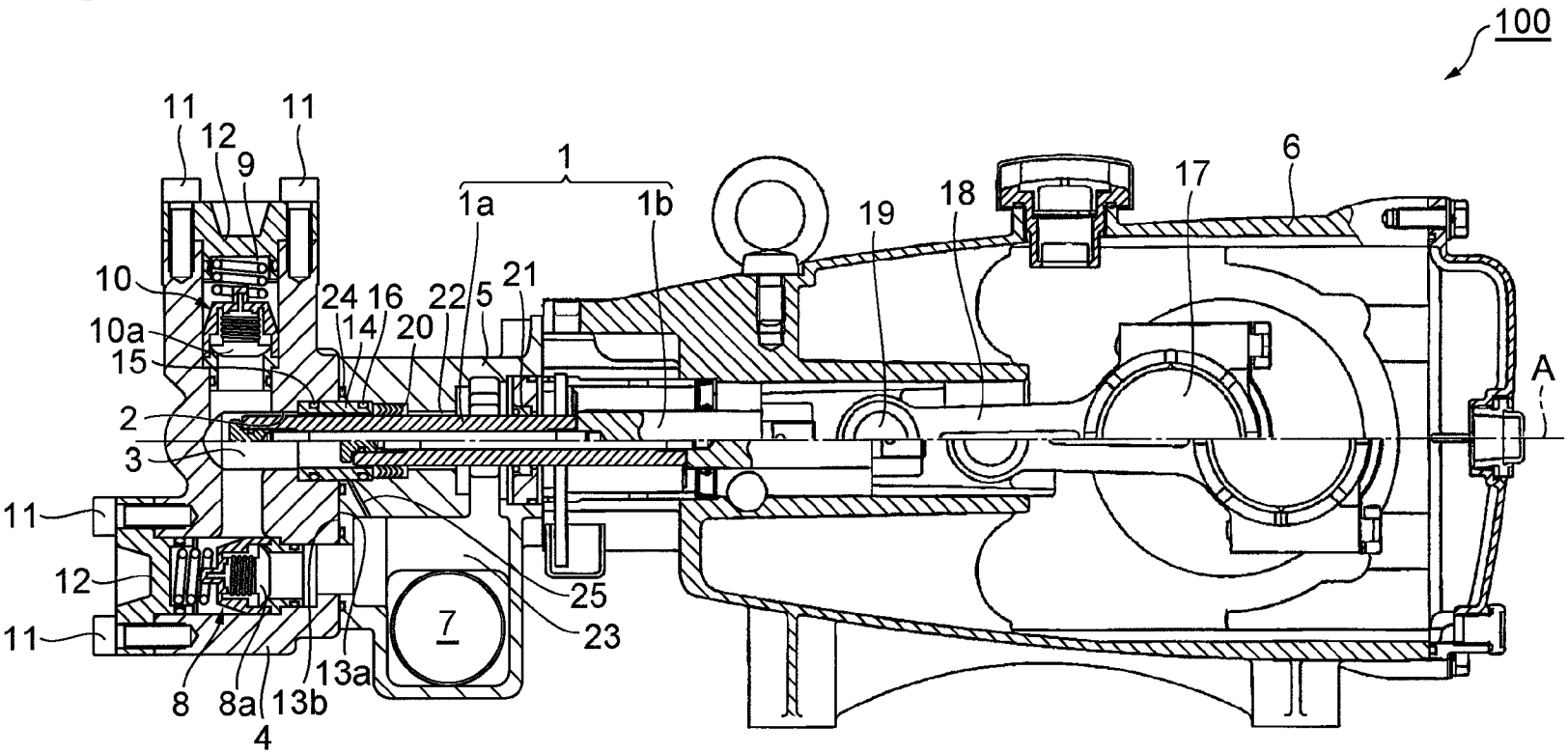
FIG. 1 is a longitudinal cross-sectional view of a reciprocating pump in accordance with a first embodiment of the present invention.
Figure 2:
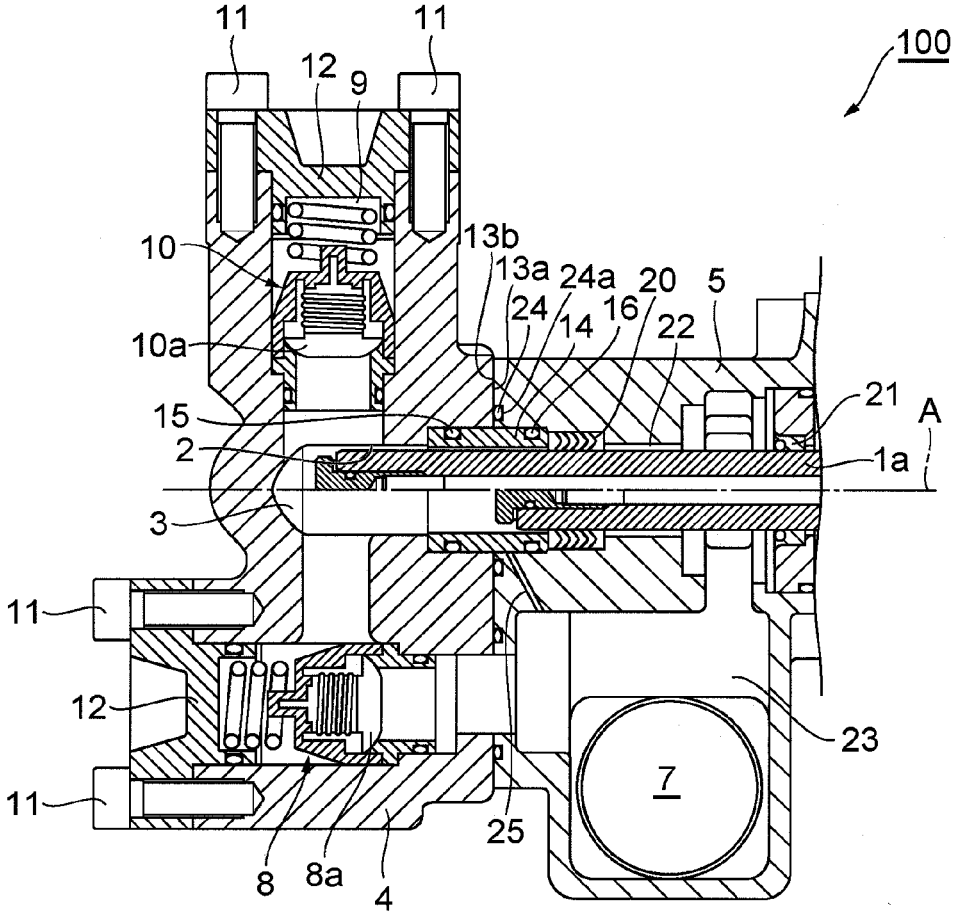
FIG. 2 is an enlarged view of the main portion of the reciprocating pump shown in FIG. 1.

Preferred embodiments of the reciprocating pump in accordance with the present invention will now be explained with reference to the accompanying drawings. FIG. 1 is a longitudinal cross-sectional view of a reciprocating pump in accordance with a first embodiment of the present invention, and FIG. 2 is an enlarged view of the main portion of the pump shown in FIG. 1. In FIG. 1, the upper half above the center line A represents a reciprocating member at the upper dead point while the lower half below the center line A represents the reciprocating member at the bottom dead point.

With reference to FIGS. 1 and 2, a reciprocating pump 100 includes the reciprocating member 1 that consists of a plunger 1*a* and a plunger rod 1*b*. The reciprocating member reciprocates in a cylinder 2 so that a pump chamber 3 provided at the leading end of the cylinder 2 produces a pumping action. The reciprocating pump 100 also has a contour including a first manifold 4 having the pump chamber 3, a second manifold 5 having the cylinder 2 communicating with the pump chamber 3 and connected to the first manifold 4, and a crankcase 6 connected to the second manifold 5. The cylinder 2 extends over both the first manifold 4 and the second manifold 5 connected to the first manifold 4. In this embodiment, the first manifold 4 functions as a discharge manifold while the second manifold 5 functions as a suction manifold. The reciprocating pump 100 is of a multiple type having multiple cylinders 2 and plungers 1*a* that are provided parallel to the direction perpendicular to the drawing.

As described above, the first manifold 4 is provided with the pumping chamber 3 communicating with the interior of the cylinder 2. The bottom of the pumping chamber 3 in the drawing communicates with an intake 7 provided in the second manifold 5, and an inlet valve 8 is disposed between the pumping chamber 3 and the intake 7. The top of the pumping chamber 3 communicates with a spout 9 provided in the first manifold 4, and an outlet valve 10 is disposed between the pumping chamber 3 and the spout 9. As shown in FIGS. 1 and 2, the inlet valve 8 and the outlet valve 10 are mounted to the first manifold 4 such that they are stoppered by a plug 12 that is connected to the first manifold 4 with a bolt 11.

The first manifold 4 is connected to the second manifold 5 by bolts or any other connecting means such that the connecting surfaces 13*a* and 13*b* confront each other. The first manifold 4 communicates with the second manifold 5 via a cylindrical communicating tube 14. The communicating tube 14 extends over both the first manifold 4 and the second manifold 5 so as to constitute a part of the cylinder 2. A first O-ring 15 is disposed between the first manifold 4 and the periphery, adjacent to the first manifold 4, of the communicating tube 14, while a second O-ring 16 is disposed between the second manifold 5 and the periphery, adjacent to the second manifold 5, of the communicating tube 14. More particularly, the first O-ring 15 and the second O-ring 16 are disposed so as to sandwich the connection surfaces 13*a* and 13*b* of the first and second manifolds 4 and 5, respectively. This ensures liquid-tight connection of the first and second manifolds 4 and 5 via the communicating tube 14.

With reference to FIG. 1, a crankshaft 17 that serves as a drive unit of the reciprocating member 1 and a connecting rod (con-rod) 18 and a piston pin 19 that are connected to the crankshaft 17 are disposed in the crankcase 6. The rotation of the crankshaft 17 allows the reciprocating member 1 to reciprocate in the horizontal direction in the drawing in the cylinder 2 by the action of the con-rod 18 and the piston pin 19 and the pumping chamber 3 provided at the leading end in the cylinder 2 to be pressurized or depressurized.

In further detail, as shown in the lower half below the centerline A in FIG. 1, the shift of the reciprocating member 1 toward the crankshaft 17 causes the pumping chamber 3 to be depressurized, so that a valve disc 8*a* of the inlet valve 8 is opened while a valve disc 10*a* of the outlet valve 10 of the first manifold 4 is closed. Thereby, working liquid is introduced into the pumping chamber 3 from the intake 7 of the second manifold 5 via the flow path of the inlet valve 8. On the other hand, as shown in the upper half above the centerline A in FIG. 1, the shift of the reciprocating member 1 remote from the crankshaft 17 causes the pumping chamber 3 to be pressurized, so that the valve disc 8*a* of the inlet valve 8 is closed while the valve disc 10*a* of the outlet valve 10 is opened. Thereby, the working liquid in the pumping chamber 3 is discharged to the spout 9 of the first manifold 4 via the flow path of the outlet valve 10. Accordingly, the working liquid is sucked and then discharged by such a pumping action.

The cylinder 2 includes an annular high-pressure seal 20 and an annular low-pressure seal 21 in that order from the pumping chamber 3. These seals 20 and 21 are in contact with the peripheral surface of the reciprocating member 1 slidably and liquid-tightly so that the cylinder 2 prevents the working liquid from leaking from the pumping chamber 3 toward the crankcase 6 via a gap between the reciprocating member 1 (plunger 1*a*) and the cylinder 2. The high-pressure seal 20 and the low-pressure seal 21 are annular member made of synthetic rubber, for example. The high-pressure seal 20 is urged toward and fixed to the crankcase 6 by the communicating tube 14.

An annular cooling region (a region in the manifold) 22 surrounding the reciprocating member 1 in the second manifold 5 between the high-pressure seal 20 and the low-pressure seal 21 is supplied with part of the working liquid sucked through the intake 7 via a suction tube (another region in the manifold) 23. The cooling region 22 cools the reciprocating member 1. Accordingly, the high-pressure seal 20 and the low-pressure seal 21 prevent the working liquid in the cooling region 22 from leaking toward the pumping chamber 3 and the crankcase 6. The pressure in the cooling region 22 and the suction tube 23 is lower than that in the pumping chamber 3 by means of the action of the high-pressure seal 20, the low-pressure seal 21, and the inlet valve 8.

In the first embodiment, an auxiliary O-ring 24 is provided between the connection surface 13*a* of the first manifold 4 and the connection surface 13*b* of the second manifold 5. More specifically, the second manifold 5 has a groove 24*a* that accommodates the auxiliary O-ring 24, on the connection surface 13*b*, outside of the communicating tube 14 in the radial direction. The auxiliary O-ring 24 is fit in the groove 24*a* to seal the gap between the connection surfaces 13*a* and 13*b* liquid-tightly.

In the first embodiment, a relief path 25 is provided between the suction tube 23 and the communicating tube 14. The relief path 25 recycles liquid leaking from at least one of the first and second O-rings 15 and 16 from upstream of auxiliary O-ring 24 to the suction tube 23, and connects the periphery of the communicating tube 14 adjacent to the pumping chamber 3 relative to the second O-ring 16 with the suction tube 23 in the second manifold 5.

In the reciprocating pump 100, liquid that flows from the two ends of the communicating tube 14 toward the first and second O-rings 15 and 16 and that leaks from at least one of the first and second O-rings 15 and 16 toward the exterior via the gap between the connection surface 13*a* of the first manifold 4 and the connection surface 13*b* of the second manifold 5 is blocked by the auxiliary O-ring 24, thereby the liquid does not flow to the exterior.

The liquid leaking from at least one of the first and second O-rings 15 and 16 is recycled to the suction tube 23 under a lower pressure via the relief path 25 provided in the second manifold 5.

In this embodiment, as described above, the auxiliary O-ring 24 provided on the connection surfaces 13*a* and 13*b* of the first and second manifolds 4 and 5, respectively, lateral to the communicating tube 14 in the radial direction can block the liquid leaking from at least one of the first and auxiliary O-ring 24 to the exterior via the connection surfaces 13*a* and 13*b*. Accordingly, the working liquid does not leak toward the exterior.

In addition, the relief path 25 recycles the liquid leaking from at least one of the first and second O-rings 15 and 16 from upstream of the second O-rings 15 to the suction tube 23 under a lower pressure relative to the pumping chamber 3. This mechanism can more effectively prevent the working liquid leaking toward the exterior.

Recycling of the leaking liquid via the relief path 25 to the suction tube 23 under a lower pressure softens the effects of the high-pressure liquid on the auxiliary O-ring 24, in other words, it can moderate the load to the auxiliary O-ring 24. This mechanism enables the working liquid to stay in the interior of the pump over an extended time period.

Second Embodiment

Figure 3:
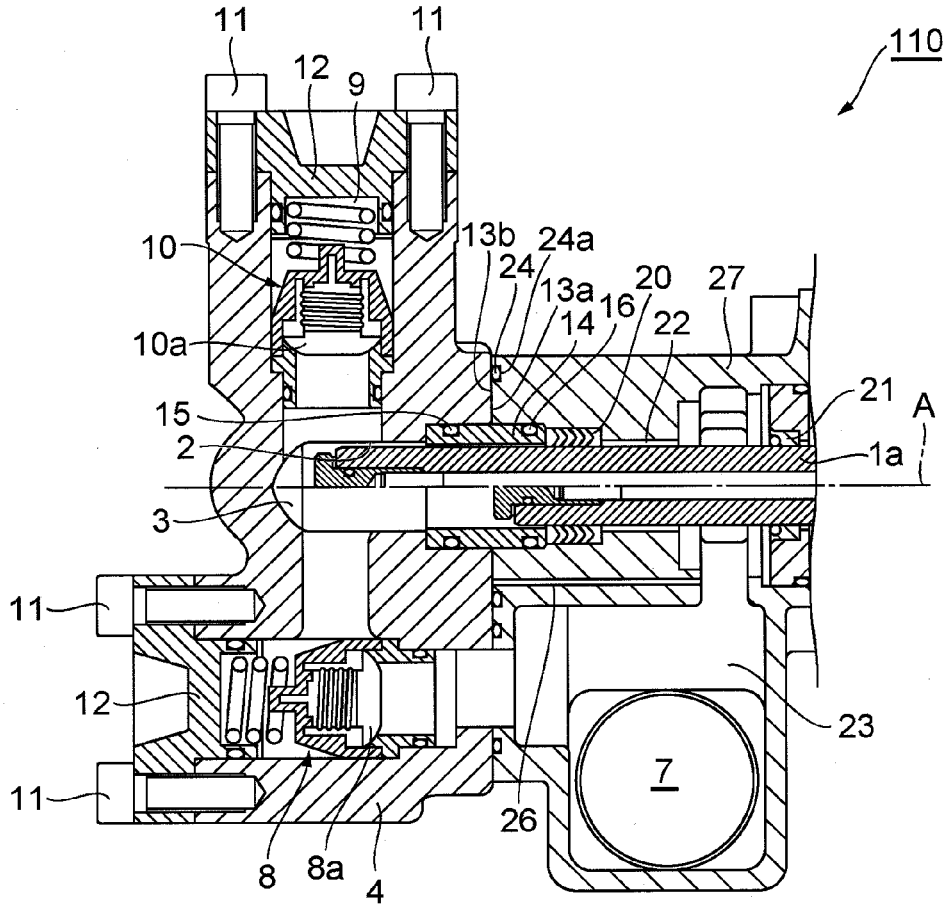
FIG. 3 is an enlarged longitudinal cross-sectional view of the main portion of a reciprocating pump in accordance with a second embodiment of the present invention.

FIG. 3 is an enlarged longitudinal cross-sectional view of the main portion of a reciprocating pump in accordance with a second embodiment of the present invention. Elements having the same functions as those in the first embodiment are referred to with the same reference numerals, and a detailed description thereof with reference to drawings is omitted.

The reciprocating pump 110 of the second embodiment includes a second manifold 27 having an alternative relief path 26 in place of the relief path 25 in the first embodiment. More specifically, the relief path 26 substantially parallels the axis line of a cylinder 2 between an auxiliary O-ring 24 and a communicating tube 14 at the lower portion (adjacent to a suction tube 23) of a second manifold 27 in the drawing and allows a connection surface 13*b* of the second manifold 27 to communicates with the suction tube 23.

Also in the reciprocating pump 110 provided with the relief path 26, the liquid leaking from at least one of a first O-ring 15 and a second O-ring 16 is recycled to the suction tube 23 under a lower pressure, upstream of the auxiliary O-ring 24, like the first embodiment. The advantageous effects (by the relief path 26 and the auxiliary O-ring 24) are substantially identical to those by the reciprocating pump 100 in the first embodiment. With the placement of the relief path 26, the auxiliary O-ring 24 between a connection surface 13*a* of a first manifold 4 and the connection surface 13*b* of the second manifold 27 and a groove 24*a* accommodating the O-ring 24 are provided outside of the communicating tube 14 in the radial direction, in comparison with the first embodiment.

Third Embodiment

Figure 4:
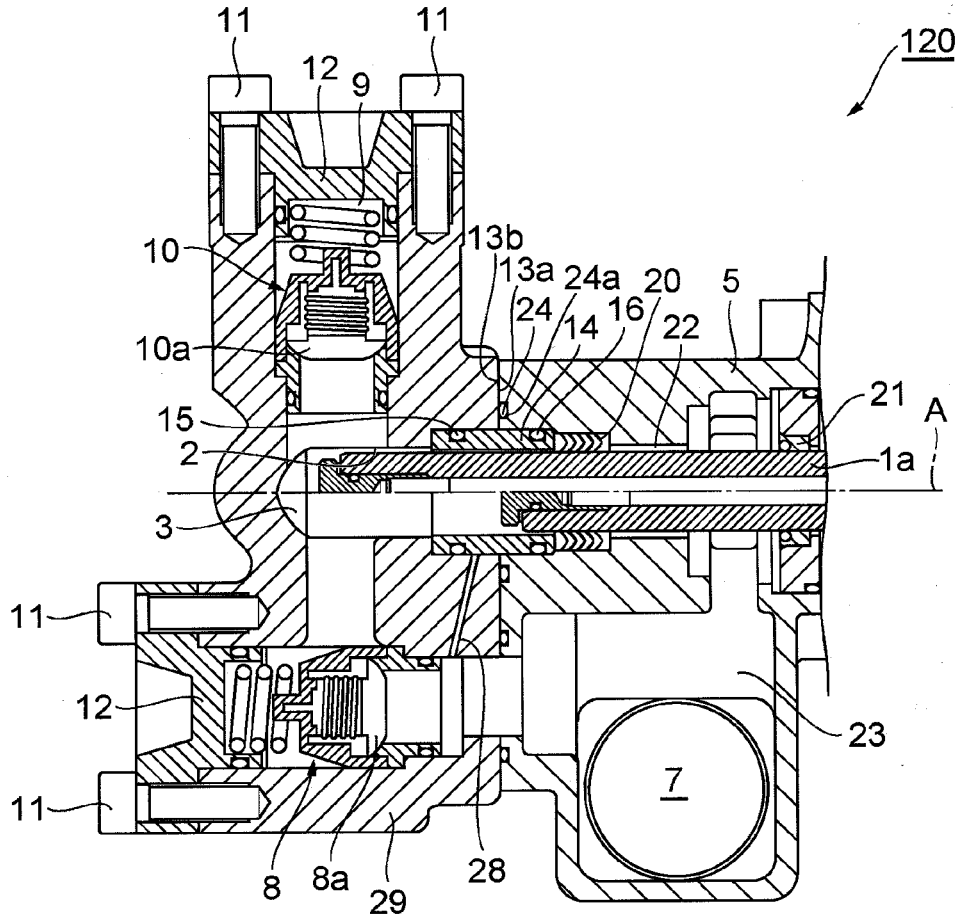
FIG. 4 is an enlarged longitudinal cross-sectional view of the main portion of a reciprocating pump in accordance with a third embodiment of the present invention.

FIG. 4 is an enlarged longitudinal cross-sectional view of the main portion of a reciprocating pump in accordance with a third embodiment of the present invention. Elements having the same functions as those in the prior embodiments are referred to with the same reference numerals, and a detailed description thereof with reference to drawings is omitted.

The reciprocating pump 120 of the third embodiment includes a first manifold 29 having an alternative relief path 28 in place of the relief path 25 or 26 in the first or second embodiment. More specifically, the relief path 28 is disposed such that the peripheral surface, adjacent to a crankcase 6 on the basis of a first O-ring 15, of a communicating tube 14 in the first manifold 29 is connected with a suction tube 23 communicating with an inlet valve 8 in the first manifold 29.

Also in the reciprocating pump 120 provided with the relief path 28, liquid leaking from at least one of the first O-ring 15 and a second O-ring 16 is recycled from upstream of an auxiliary O-ring 24 to the suction tube 23 under a lower pressure, like the prior embodiments. The advantageous effects (by the relief path 28 and the auxiliary O-ring 24) are substantially identical to those by the reciprocating pump 100 in the first embodiment or the reciprocating pump 110 in the second embodiment.

Fourth Embodiment

Figure 5:
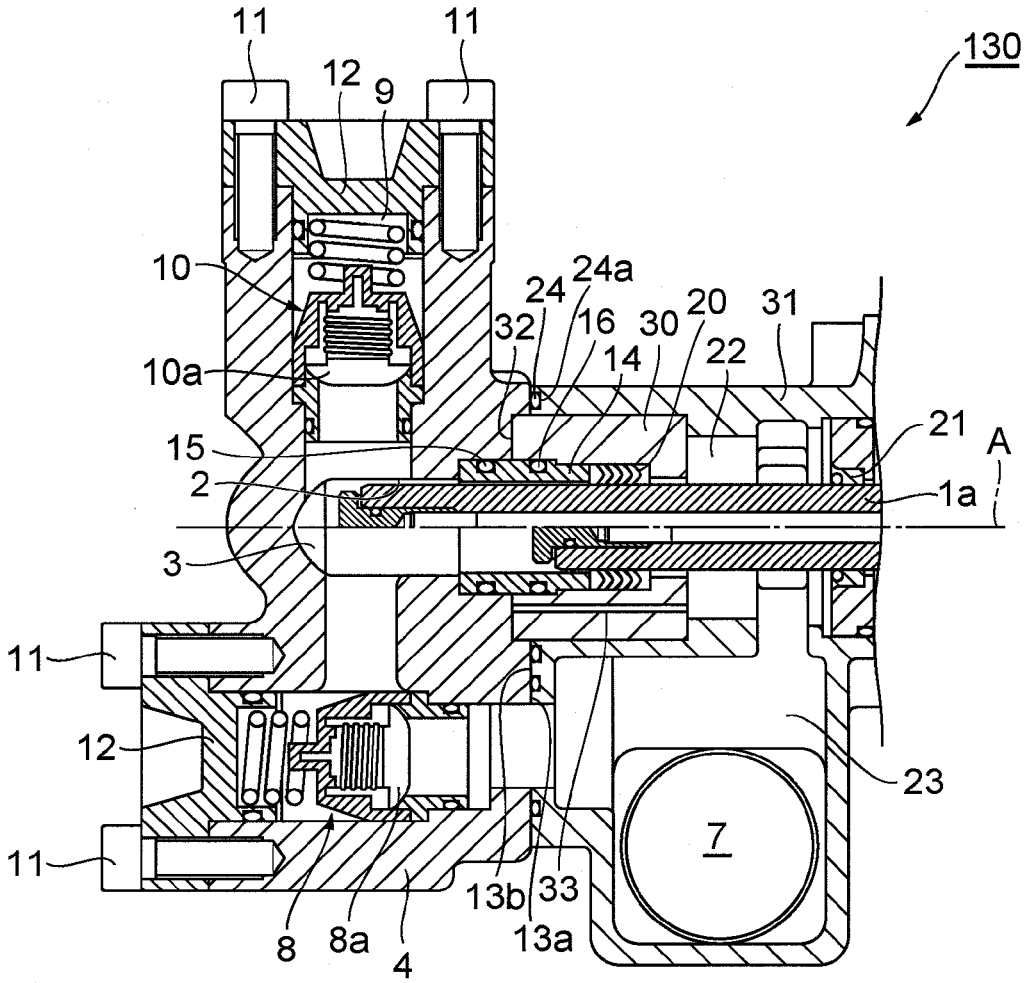
FIG. 5 is an enlarged longitudinal cross-sectional view of the main portion of a reciprocating pump in accordance with a fourth embodiment of the present invention.

FIG. 5 is an enlarged longitudinal cross-sectional view of the main portion of a reciprocating pump in accordance with a fourth embodiment of the present invention. Elements having the same functions as those in the first embodiment are referred to with the same reference numerals, and a detailed description thereof with reference to drawings is omitted.

The reciprocating pump 130 of the fourth embodiment is provided with a second manifold 31 having a cylindrical vane case 30 therein. The vane case 30 has a leading end 32, adjacent to a pumping chamber 3, that is disposed between a first O-ring 15 and a second O-ring 16 while the vane case 30 is fit on the outsides of a communicating tube 14 and a high-pressure seal 20, thereby the vane case 30 constitutes the leading-end interior of the second manifold 31. The vane case 30 disposed described above defines a cooling region 22 having a larger diameter toward a crankcase 6. With the placement of the vane case 30, an auxiliary O-ring 24 and a groove 24*a* accommodating the O-ring 24 are provided outside of the vane case 30 in the radial direction.

The vane case 30 is also provided with a relief path 33 that recycles leaking liquid to the cooling region 22. The relief path 33 substantially parallels the axis line of a cylinder 2 at the lower portion (adjacent to a cooling tube 23) of the vane case 30 in the drawing and connects the leading end 32 of the vane case 30 with the cooling region 22.

Also in the reciprocating pump 130 provided with the relief path 33, liquid leaking from at least one of a first O-ring 15 and a second O-ring 16 is recycled from upstream of the auxiliary O-ring 24 to the cooling region 22 under a lower pressure, like the prior embodiments. The advantageous effects (by the relief path 33 and the auxiliary O-ring 24) are substantially identical to those by the reciprocating pump 100, 110, or 120 in the first, second, or third embodiment, respectively.

In the reciprocating pump 130 of the fourth embodiment, the relief path 33 is provided to the vane case 30 to release the leaking liquid. Even if the relief path 33 is not provided, the leaking liquid can be recycled because the gap between the periphery of the vane case 30 and the second manifold 31 communicates with a suction tube 23 under a lower pressure.

Fifth Embodiment

Figure 6:
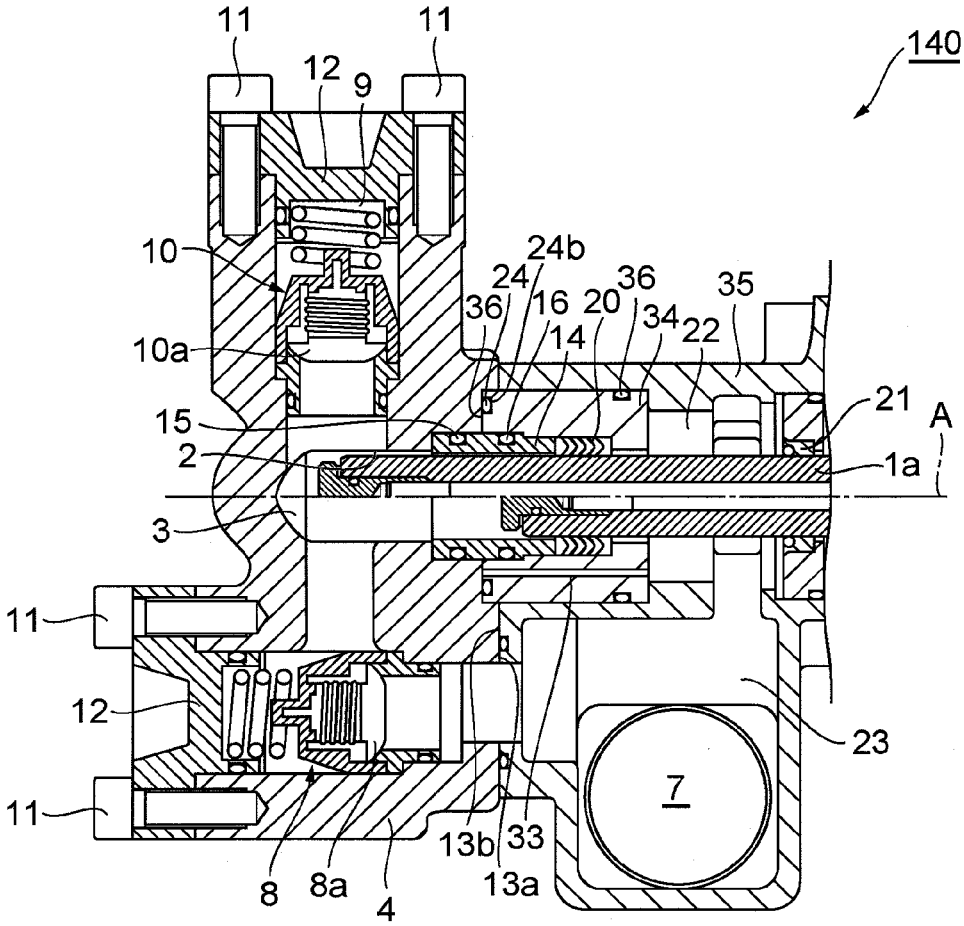
FIG. 6 is an enlarged longitudinal cross-sectional view of the main portion of a reciprocating pump in accordance with a fifth embodiment of the present invention.

FIG. 6 is an enlarged longitudinal cross-sectional view of the main portion of a reciprocating pump in accordance with a fifth embodiment of the present invention. Elements having the same functions as those in the first embodiment are referred to with the same reference numerals and a detailed description thereof with reference to drawings is omitted.

The reciprocating pump 140 of the fifth embodiment includes a second manifold 35 having an alternative vane case 34 in place of the vane case 30 in the fourth embodiment. The vane case 34 is provided with groove 24*b* outside of a relief path 33 in the radial direction, and an auxiliary O-ring 24 is disposed in the groove 24*b*. An O-ring 36 is disposed between the periphery of the vane case 34 and the second manifold 35.

Also in the reciprocating pump 140 provided with the vane case 34, the liquid leaking from at least one of a first O-ring 15 and a second O-ring 16 is blocked by the auxiliary O-ring 24 between the periphery of the vane case 34 and the first manifold 4, as in the prior embodiments. The advantageous effects (by the auxiliary O-ring 24 and the relief path 33) are substantially identical to those by the reciprocating pump 100, 110, 120 or 130 in the first, second, third or fourth embodiment, respectively.

Sixth Embodiment

Figure 7:
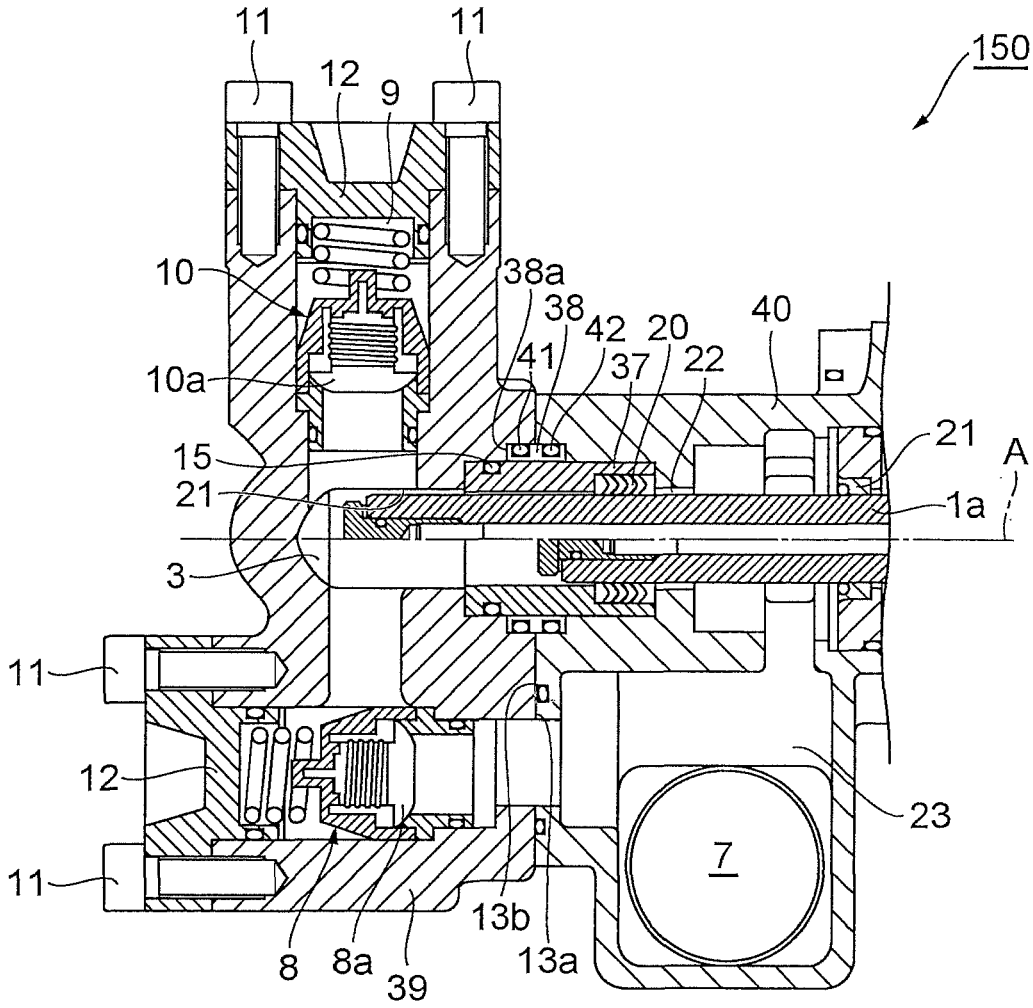
FIG. 7 is an enlarged longitudinal cross-sectional view of the main portion of a reciprocating pump in accordance with a sixth embodiment of the present invention.

FIG. 7 is an enlarged longitudinal cross-sectional view of the main portion of a reciprocating pump in accordance with a sixth embodiment of the present invention. Elements having the same functions as those in the first embodiment are referred to with the same reference numerals and a detailed description thereof with reference to drawings is omitted.

The reciprocating pump 150 of the sixth embodiment is provided with a primary communicating tube 37 (corresponding to the communicating tube 14) and a secondary communicating tube 38. The primary communicating tube 37 is cylindrical and functions as a part of a cylinder 2. The primary communicating tube 37 extends over both a first manifold 39 and a second manifold 40, and is surrounded by a high-pressure seal 20. A first O-ring 15 is disposed between the first manifold 39 and the periphery, adjacent to the first manifold 39, of the primary communicating tube 37. The high-pressure seal 20 is urged and fixed by the primary communicating tube 37 toward a crankcase 6.

The secondary communicating tube 38 is cylindrical and is fit on the periphery of the primary communicating tube 37 such that its leading end 38*a* adjacent to the pumping chamber 3 resides behind a first O-ring 15. Furthermore, the secondary communicating tube 38 extends over both a first manifold 39 and a second manifold 40 in the leading-end interior of the second manifold 40. In other words, the primary communicating tube 37 and the secondary communicating tube 38 are concentrically disposed in the radial direction. A third O-ring 41 is disposed between the first manifold 39 and the periphery, adjacent to the first manifold 39, of the secondary communicating tube 38, while a fourth O-ring 42 is disposed between the second manifold 40 and the periphery, adjacent to the second manifold 40, of the secondary communicating tube 38. In other words, the third and fourth O-rings 41 and 42 are disposed so as to sandwich the connection surfaces 13*a* and 13*b* of the first and second manifolds 39 and 40, respectively. Accordingly, the first and second manifolds 39 and 40 are tightly connected to each other by the primary communicating tube 37 and the secondary communicating tube 38.

In addition, the gap between the periphery, adjacent to the second manifold 40, of the primary communicating tube 37 and the first manifold 39 and between the same periphery and the second manifold 40 communicate with a suction tube 23 under a lower pressure. Accordingly, a closed region defined by the third O-ring 41 and the fourth O-ring 42 of the secondary communicating tube 38 overlaps with the region of the suction tube 23 under a lower pressure. Thus, the third and fourth O-rings 41 and 42 are under a lower pressure compared to the pumping chamber 3.

In the reciprocating pump 150 provided with the primary communicating tube 37 and the secondary communicating tube 38, the leading end 38*a* adjacent to the pumping chamber 3 surrounds the primary communicating tube 37 behind the first O-ring 15, and the secondary communicating tube 38 extending over both the connection surfaces 13*a* and 13*b* of the first and second manifolds 39 and 40, respectively, is provided with the third O-ring 41 and the fourth O-ring 42; thus, the liquid leaking from the first O-ring 15 can be blocked by the third O-ring 41 and the fourth O-ring 42 before the liquid leaks to the exterior. In addition, a gap between the periphery of the primary communicating tube 37 behind the first O-ring 15 and the first manifold 39 and between the same periphery and the second manifold 40 communicates with the suction tube 23 under a lower pressure compared to the pumping chamber 3; thus, the leaking liquid is recycled to the suction tube 23 under the lower pressure via the gap. Accordingly, the working liquid does not leak to the exterior.

As described above, the leaking liquid is recycled to the suction tube 23 under the lower pressure via the gap, hence, no relief path to introduce the leaking liquid to the suction tube 23 is required, resulting in additional advantages such as ready processing with reduced process costs.

In the case of toxic working liquid or expensive liquid for special use, leakage of liquid to the exterior of the pump is undesirable, in view of environmental protection and material costs. Furthermore, leaking liquid may cause corrosion of bolts and other elements; however, the reciprocating pump 150 of the present invention, which does not leak the working liquid to the exterior, does not have such disadvantages.

The present invention is explained based on the embodiments above; however, the present invention should not be limited to these embodiments. For example, a single relief path is provided in these embodiments. In stead, multiple relief paths may be provided by combining the configurations of these embodiments, and the position of the auxiliary O-ring 24 may be varied at the same time. In conclusion, the auxiliary O-ring 24 may be provided between the manifolds outside of the communicating tube 14 in the radial direction, while the relief path may be configured to recycle the liquid leaking from at least one of the first and second O-rings 15 and 16 to the region in the manifolds under a lower pressure. The groove accommodating the auxiliary O-ring 24 may be located at an element opposed to that described above.

The invention claimed is:

1. A reciprocating pump including a cylinder, a reciprocating member reciprocating in the cylinder, and a pumping chamber provided at the leading end of the cylinder, the pumping chamber producing a pumping action, the reciprocating pump comprising:

a first manifold having the pumping chamber;

a second manifold that has the cylinder communicating with the pumping chamber and that is connected to the first manifold;

a cylindrical communicating tube that extends over both the first manifold and the second manifold so as to constitute a part of the cylinder;

a first O-ring disposed between the first manifold and the periphery, adjacent to the first manifold, of the communicating tube;

a second O-ring disposed between the second manifold and the periphery, adjacent to the second manifold, of the communicating tube;

an auxiliary O-ring (24) disposed between a connection surface (13*a*) of the first manifold and a connection surface of the second manifold outside of the communicating tube in the radial direction;

a relief path configured to recycle liquid leaking from at least one of the first and second O-rings from upstream of the auxiliary O-ring to regions in the manifolds under a lower pressure relative to the pumping chamber, the relief path being provided in at least one of the first manifold and the second manifold; and a cylindrical vane case, the leading end, adjacent to the pumping chamber, of the vane case being disposed between the first O-ring and the second O-ring, the vane case being fit on the periphery of the communicating tube, thereby the vane case constituting the leading-end interior of the second manifold.

2. A reciprocating pump including a cylinder, reciprocating member reciprocating in the cylinder, and a pumping chamber provided at the leading end of the cylinder, the pumping chamber producing a pumping action, the reciprocating pump comprising:

a first manifold having the pumping chamber;

a second manifold that has the cylinder communicating with the pumping chamber and that is connected to the first manifold;

a primary cylindrical communicating tube that extends over both the first manifold and the second manifold so as to constitute a part of the cylinder;

a first O-ring disposed between the first manifold and the periphery, adjacent to the first manifold, of the primary communicating tube;

a secondary cylindrical communicating tube that is fit on the periphery of the primary communicating tube such that the leading end adjacent to the pumping chamber resides at the backward of the first O-ring and that extends over both the first manifold and the second manifold in the leading-end interior of the second manifold;

a second O-ring disposed between the first manifold and the periphery, adjacent to the first manifold, of the secondary communicating tube; and a third O-ring disposed between the second manifold and the periphery, adjacent to the second manifold, of the secondary communicating tube, wherein a gap between the periphery of the primary communicating tube behind the first O-ring and the first manifold and between the same periphery and the second manifold communicates with regions in the manifolds under a lower pressure relative to the pumping chamber.

* * * * *